US009145598B2

(12) United States Patent
Oshchepkov

(10) Patent No.: US 9,145,598 B2
(45) Date of Patent: Sep. 29, 2015

(54) NITROGEN CONTAINING, LOW NICKEL SINTERED STAINLESS STEEL

(75) Inventor: Denis Oshchepkov, Saint Petersburg (RU)

(73) Assignee: HOGANAS AB (PUBL), Hoganas (SE)

( * ) Notice: Subject to any disclaimer, the term of this patent is extended or adjusted under 35 U.S.C. 154(b) by 596 days.

(21) Appl. No.: 13/502,303

(22) PCT Filed: Oct. 14, 2010

(86) PCT No.: PCT/EP2010/065456

§ 371 (c)(1),
(2), (4) Date: Apr. 26, 2012

(87) PCT Pub. No.: WO2011/045391

PCT Pub. Date: Apr. 21, 2011

(65) Prior Publication Data

US 2012/0201712 A1 Aug. 9, 2012

Related U.S. Application Data

(60) Provisional application No. 61/252,185, filed on Oct. 16, 2009.

(30) Foreign Application Priority Data

Oct. 16, 2009 (SE) ..... 0950765

(51) Int. Cl.

| | |
|---|---|
| ***C22C 33/02*** | (2006.01) |
| ***C22C 38/00*** | (2006.01) |
| ***C22C 38/02*** | (2006.01) |
| ***C22C 38/04*** | (2006.01) |
| ***C22C 38/40*** | (2006.01) |

(52) U.S. Cl.

CPC ..... *C22C 33/0285* (2013.01); *C22C 38/001* (2013.01); *C22C 38/008* (2013.01); *C22C 38/02* (2013.01); *C22C 38/04* (2013.01); *C22C 38/40* (2013.01)

(58) Field of Classification Search

None

See application file for complete search history.

(56) References Cited

U.S. PATENT DOCUMENTS

| | | | |
|---|---|---|---|
| 4,240,831 | A | 12/1980 | Ro et al. |
| 4,314,849 | A | 2/1982 | Ro et al. |
| 4,331,478 | A | 5/1982 | Ro et al. |
| 4,340,432 | A | 7/1982 | Hede |
| 4,350,529 | A | 9/1982 | Ro et al. |
| 4,420,336 | A | 12/1983 | Klar et al. |
| 5,284,530 | A | 2/1994 | Azuma et al. |
| 5,603,072 | A | 2/1997 | Kouno et al. |
| 5,714,115 | A | 2/1998 | Speidel et al. |
| 6,168,755 | B1 | 1/2001 | Biancaniello et al. |
| 6,293,233 | B1 | 9/2001 | Hiraoka |
| 6,682,582 | B1 * | 1/2004 | Speidel ..... 75/252 |

FOREIGN PATENT DOCUMENTS

| | | | |
|---|---|---|---|
| CN | 101338385 | A | 1/2009 |
| DE | 31 17 486 | A1 | 1/1982 |
| EP | 0 534 864 | A1 | 3/1993 |
| EP | 0 665 300 | A1 | 8/1995 |
| JP | 62-222043 | A | 9/1987 |

OTHER PUBLICATIONS

Pao, et al, "On the corrosion Resistance of P/M Austenitic Stainless Steels", Proceedings of International Powder Metallurgy Conference, Jun. 30, 1982, p. 359-374.*

Causton, et al, "ASM Handbook, vol. 7, Powder Metal Technologies and Applications, Machinability of P/M Steels", p. 1708-1711.*

International Search Report (PCT/ISA/210) issued on Mar. 15, 2011, by European Patent Office as the International Searching Authority for International Application No. PCT/EP2010/065456.

Written Opinion (PCT/ISA/237) issued on Mar. 15, 2011, by European Patent Office as the International Searching Authority for International Application No. PCT/EP2010/065456.

* cited by examiner

*Primary Examiner* — George Wyszomierski
*Assistant Examiner* — Ngoclan T Mai
(74) *Attorney, Agent, or Firm* — Buchanan Ingersoll & Rooney P.C.

(57) ABSTRACT

A water atomized stainless steel powder which comprises by weight-%:

10.5-30.0 Cr 0.5-9.0 Ni 0.01-2.0 Mn 0.01-3.0 Sn 0.1-3.0 Si 0.01-0.4 N optionally max 7.0 Mo optionally max 7.0 Cu optionally max 3.0 Nb optionally max 6.0 V balance iron and max 0.5 of unavoidable impurities.

17 Claims, 4 Drawing Sheets

NITROGEN CONTAINING, LOW NICKEL SINTERED STAINLESS STEEL

FIELD OF THE INVENTION

The present invention concerns a sintered stainless steel alloy powder, a powder composition, the method of making sintered components from the powder composition, and sintered components made from the powder composition. The powder and powder composition are designed to make possible the production of low nickel, low manganese sintered stainless steel components with a minimum content of 40% austenitic phase, containing from 0.1% to 1% Nitrogen.

BACKGROUND OF THE INVENTION

Literature regarding high nitrogen containing stainless steel teaches about the demand for high manganese contents, usually above 5% by weight, in order to increase nitrogen solubility. In order to reduce nickel content, even higher amounts of Mn are recommended. High nitrogen, low nickel wrought stainless steels with contents above 10% Mn are often mentioned in literature and exist commercially.

Compressibility is an important property in PM technology and is a limiting factor when designing an alloy. As high additions of Mn remarkably reduce compressibility, this is not considered an option when using the PM technique. It is also important for the components to have good green strength after compression, in order for the parts not to break during production. Water atomized powder are preferred because they greatly outperform gas atomized powders in this aspect, thanks to the irregular shape of the particles.

Today there are four types of stainless steels represented in the PM industry. Martensitic stainless steels: Typical grade—410. Fe—Cr alloy with low chromium content and generally high strength and hardness.

Ferritic stainless steels: Typical grades 430, 434 Fe—Cr alloy with Cr content 18% by weight, some grades stabilised by Mo or Nb. These steels generally possess high corrosion resistance in air at temperature up to 650° C., low resistance against electrochemical corrosion and medium mechanical properties.

Austenitic stainless steels: Typical grades 304, 316, 310. Fe—Cr—Ni alloys contain from 17 to 25% Cr and from 10 to 20% of Ni, by weight. Some grades contain Mo for improving pitting resistance in quantity up to 6 wt % (e.g. grade Cold 100) These steels generally possess austenitic structure, excellent corrosion resistance but low mechanical properties when sintered in pure hydrogen. Mechanical properties of these steels can be improved by sintering in dissociated ammonia atmosphere (grades 316N1, 316N2, 304N1, 304N2 according MPIF standard No 35), but corrosion resistance will be decreased in this case, because of $Cr_2N$ formation during cooling. The other drawback for these steels is their high cost because of the high amount of Ni needed for stabilising austenitic structure and Mo-content to improve pitting resistance.

Duplex grades: Typical grade 17-4. Fe—Cr—Ni alloys contain from 17 to 20% Cr and 3 to 5% Ni, by weight. These steels possess high mechanical properties and medium corrosion resistance.

It is known from U.S. Pat. No. 4,240,831 and U.S. Pat. No. 4,350,529 that corrosion resistance of the 300 series austenitic stainless steels, sintered in nitrogen containing atmosphere can be increased by additional alloying of the powder by elements, selected from the group: Sn, Al, Pb Zn, Mg, rare earth metals, As, Bi. According to these patents stated metals decrease the amount of surface silicon oxides on the powder surface and thereby improve corrosion resistance. Tin is mentioned in literature as an addition that improves corrosion resistance of standard stainless steel grades. It is believed that tin addition decreases the Cr content close to the particle surface which helps to prevent $Cr_2N$ formation during cooling in nitrogen containing atmospheres. U.S. Pat. No. 4,420,336, U.S. Pat. No. 4,331,478 and U.S. Pat. No. 4,314,849 all concern tin additions to standard PM stainless steel powder grades to improve corrosion properties. However, neither these patents nor U.S. Pat. No. 4,240,831 or U.S. Pat. No. 4,350,529 teach about stainless steels with nickel contents below 11.2 wt %.

The use of high cooling rate for sintering standard 300 series stainless steel in atmospheres containing nitrogen in quantities up to 25 volume % has been suggested in literature. It is well known that high cooling rates in the temperature range from 1100 to 700° C. prevents $Cr_2N$ formation during cooling. However, cooling rates suggested for this purpose are about 195° C./min, which is quite difficult to achieve in the majority of commercially available furnaces.

CN101338385A concerns near full density, high nitrogen, stainless steel products. The products are obtained by subjecting stainless steel powders including 0.1-10 wt % manganese, 5-25 wt % nickel and 0.4-1.5 wt % nitrogen to hot isostatic pressing. All examples in CN101338385A contain above 5 wt % Mn and nickel contents of 9 wt % and above.

Other patents, such as U.S. Pat. No. 6,168,755B1, concern nitrogen alloyed stainless steels produced by nitrogen gas atomization. However, gas atomized powders are less suitable for the press and sintering technique.

U.S. Pat. No. 5,714,115 concerns a low nickel stainless steel alloy with high nitrogen content. However, the manganese content in this alloy is 2 to 26 wt %.

U.S. Pat. No. 6,093,233 concerns a nickel free (less than 0.5 wt %) stainless steel having a ferritic and magnetic structure with at least 0.4 wt % of nitrogen.

OBJECTS OF THE INVENTION

One object of the invention is to provide a powder, powder composition and a method suitable for producing relatively low nickel and low manganese sintered stainless steel components with at least 40 vol-% austenitic phase Another object is to provide a powder, powder composition and a method suitable for producing relatively low nickel and low manganese stainless steel components having comparably good corrosion resistance and mechanical properties.

Yet another object of the invention is to provide a method of producing sintered stainless steel components, reducing the cost of the sintering process during the component manufacturing, while keeping good corrosion properties.

SUMMARY OF THE INVENTION

At least one of these objects is accomplished by:

A water atomized stainless steel powder which comprises by weight-%: 10.5-30.0 Cr, 0.5-9.0 Ni, 0.01-2.0 Mn, 0.01-3.0 Sn, 0.1-3.0 Si, 0.01-0.4 N, and max 0.5 of unavoidable impurities such as carbon and oxygen, with the balance being iron. The water atomized powder according to the invention may optionally contain typical additions to improve corrosion or sintered properties, such as Mo (max 7.0 wt %), Cu (max 7.0 wt %) or common stainless steel stabilizer elements, such as Nb (max 3.0 wt %) or V (max 6.0 wt %), if these additions are regarded as necessary for the component to be produced. Such a powder can be used to produce a relatively low nickel and low manganese stainless steel components with at least 40% austenitic phase, and having comparably good corrosion resistance and mechanical properties.

A composition based on the stainless steel powder having, by weight-% of the composition: 0.05-2.0 lubricant (any commercial lubricant suitable for stainless steel can be used). Additional alloying elements, such as powders containing Cu, Mo, Cr, Ni, and/or C, hard phase materials and machinability enhancing agents, can optionally be added to the composition for modification of dimensional changes and material properties. Such a powder composition can be used to produce a relatively low nickel and low manganese stainless steel components with at least 40% austenitic phase, and having comparably good corrosion resistance and mechanical properties.

A method for producing sintered components comprising the steps of:

a) preparing an iron-based stainless steel powder composition of above, b) subjecting the composition to compaction between 400 and 2000 MPa, c) sintering the obtained green component in a nitrogen containing atmosphere, preferably 5-100% $N_2$, at temperatures between 1000-1400° C., preferably 1100-1350° C., and more preferably 1200-1280° C.

d) optionally subjecting the sintered component to rapid cooling.

e) optionally, the sintered component can be solution annealed at temperatures higher than 1000° C. followed by rapid cooling or quenching.

Such a method can be used to produce a relatively low nickel and low manganese stainless steel components with at least 40% austenitic phase, and having comparably good corrosion resistance and mechanical properties, while reducing the cost of the sintering process during the component manufacturing.

Optionally the component is subjected to a nitriding step prior to the sintering step c), which nitriding step is performed at a temperature that is 20-300° C. lower than the sintering temperature, preferably 40-150° C. lower. The atmosphere during the nitriding step having a content of 5-100% $N_2$.

A sintered stainless steel component, comprising by weight-%: 10.5-30.0 Cr, 0.5-9.0 Ni, 0.01-2.0 Mn, 0.01-3.0 Sn, 0.1-3.0 Si, 0.1-1.0 N, optionally max 3.0 C, optionally max 7.0 Mo, optionally max 7.0 Cu, optionally max 3.0 Nb, optionally max 6.0 V, balance iron and max 0.5 of unavoidable impurities, and having a microstructure comprising at least 40% austenitic phase.

DETAILED DESCRIPTION OF THE INVENTION

Figure 1:
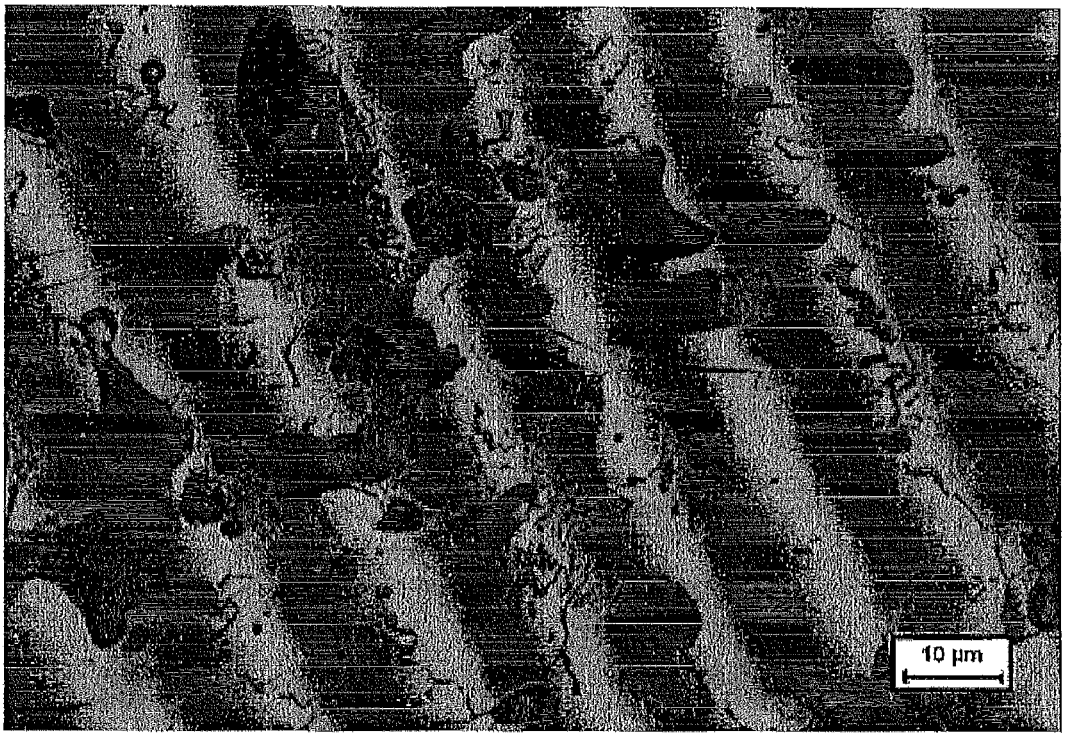
FIG. 1 shows the microstructure of a steel component made from Powder 1 after sintering in the mix 50% Hydrogen+50% Nitrogen followed by conventional cooling, etched by Glyceregia.

Preparation of the Stainless Steel Powder.

Stainless steel powder is produced by water atomization of an iron melt. The atomized powder can further be subjected to an annealing process. The particle size of the atomized powder alloy could be any size as long as it is compatible with the press and sintering or powder forging processes.

Contents of the Steel Powder

Chromium (Cr) is present in the range of 10.5 to 30% by weight. Below 10.5 wt % of Cr the steel will not be stainless. The nitrogen solubility in the alloy containing 10.5 wt % Cr will be approximately 0.1 wt % which corresponds to lower limit of nitrogen in present invention.

A Cr content above 30 wt % promotes embrittlement of the materials by mean of sigma-phase formation. High amount of Cr also reduces the powder compressibility. On the other hand Cr promotes ferrite phase formation, thus the more Cr, the more Ni addition is needed in order to stabilise austenite. Therefore, the Ni content should be at least 0.5 wt %, preferably at least 1 wt %. In one embodiment the minimum content of Ni by weight % is restricted to: min Ni0.5+(Cr-10.5)*0.1. As for the upper limit the content of Ni in the alloy is restricted to max 9.0 wt %, preferably max 8 wt %. More than this is unnecessary since Nitrogen is also present and will also help stabilize the austenite in the final component.

Manganese increases the stability of the austenitic phase and increases nitrogen solubility in the steel. Because Mn remarkably reduces the compressibility of the powder, the preferable amount of Mn should be less than 2 wt %, preferably less than 1 wt %, and more preferably less than 0.5 wt %, and even more preferably less than 0.2 wt %. Manganese levels below 0.01 wt % are extremely difficult to achieve with current atomizing technology and has hence been set as the lower limit.

Tin is present in the powder in contents up to 3.0% by weight in order to suppress $Cr_2N$ formation as well as formation of other chromium nitrides during cooling, and thus reduces the cooling rate needed to avoid $Cr_2N$. The formation of chromium nitrides withdraws chromium from the matrix thus reducing the corrosion resistance. However, Tin contents above 3.0 wt % will tend to loan intermetallic phases in the alloy which deteriorates corrosion properties. Preferably the tin content is up to 2.0% by weight.

In theory, Tin-free alloys could be used, but cooling rates after sintering would need to be extremely fast in order to prevent excess $Cr_2N$ formation. In the commercially available furnaces of today this would not be an option, therefore at least 0.01 wt %, preferably at least 0.1 wt %, more preferably 0.3 wt % of tin is required to suppress $Cr_2N$ formation.

Nitrogen can be added to the powder during its manufacturing and/or to the component during the sintering process.

The amount of added nitrogen during the manufacture of the powder should be at most 0.4% by weight which corresponds to the maximum solubility of the nitrogen in liquid metal at melting temperature under atmosphere pressure. Nitrogen levels below 0.01 wt % are extremely difficult to achieve with current atomizing technology and, hence the lower limit for nitrogen in the powder is set to 0.01 wt %. During manufacture of the powder nitrogen can be added by means of using nitrogen alloyed ferroalloys such as high nitrogen FeCr, CrN, SiN or other nitrogen containing additives as raw materials for the melt. Nitrogen can also be added to the powder by performing the water atomization or the melting process in a nitrogen containing atmosphere. A too high content of nitrogen in the powder will affect compressibility adversely. However, the powder can optionally be allowed to have a nitrogen content up to 0.4% weight in order to reduce the amount of nitrogen alloying necessary during sintering.

Molybdenum can optionally be added in amount up to around 7.0% by weight in order to additionally improve pitting resistance of the material according to the formula PREN (pitting resistance equivalent number)=% Cr+3.3*% Mo+16*% N. However, above 7 wt % Mo, there is not much improvement in corrosion resistance and it has hence been set as the upper limit. The PREN number forecasts the level of the pitting corrosion resistance of the alloy according to its chemical composition. The higher the PREN number, the better the pitting resistance. For example, the PREN number of the standard 316L grade, calculated using the nominal alloying element contents, is 24.3. This steel can withstand the corrosion in marine atmosphere. Stainless grades with PREN number less than 20 demonstrate measurable weight loss in marine environment. In one embodiment the Mo content is 0.01-1.5 wt %.

Copper can optionally be added to the steel in contents up to 7.0% by weight as a stabiliser of the austenitic phase. The upper limit of the copper content corresponds to the maximum solubility of the copper in the austenite.

If no carbon, in the form of graphite or other carbon containing substances, is to be added when preparing the powder composition, Niobium can optionally be added to the steel in contents up to 1.0% by weight as a stabilizer to the powder to prevent $Cr_2N$ formation because it has stronger affinity to the nitrogen, comparing with Cr. Higher contents may affect compressibility adversely. However, if carbon, in the form of graphite, is to be added when preparing the powder composition, Niobium can optionally be added to the powder in contents up to 3.0% by weight, in this case as a carbide-former in order to improve mechanical properties.

If no carbon, in the form of graphite or other carbon containing substances, is to be added when preparing the powder composition, Vanadium can be added to the steel in contents up to 0.6% by weight as a stabilizer to the powder to prevent $Cr_2N$ formation because it has stronger affinity to the nitrogen, comparing with Cr. Higher contents may affect compressibility adversely. However, if carbon, in the form of graphite or other carbon containing substances, is to be added when preparing the powder composition, Vanadium can be added to the steel in content up to 6.0% by weight, in this case as a carbide former in order to improve the wear resistance of the material. Vanadium is a very strong ferrite stabilizer and will increase Cr potential of the stainless steel. Adding more than 6.0 wt % V would thus cause excessive ferrite structure in the material after sintering which is not desired in the context of the invention.

Powder Composition

Before compaction the water atomized stainless steel powder can optionally be mixed with any commercial lubricant suitable for stainless steel manufacturing. Additional alloying elements, such as powders containing Cu, Mo, Cr, Ni, B and/or C, hard phase materials and machinability enhancing agents, can optionally be added to the composition for modification of dimensional changes and material properties.

Lubricants are added to the composition in order to facilitate the compaction and ejection of the compacted component. The addition of less than 0.05% by weight of the composition of lubricants will have insignificant effect and the addition of above 2% by weight of the composition will result in a too low density of the compacted body. Lubricants may be chosen from the group of metal stearates, waxes, fatty acids and derivates thereof, oligomers, polymers and other organic substances having lubricating effect.

Carbon may optionally be added as graphite powder with the objective to have it present in solid solution in the sintered component. Carbon in solid solution will stabilize austenite, strengthen the material and in some cases increase corrosion resistance, especially if the very high cooling rates are applicable. However, if no carbide formers (other than Cr) are present in the material the addition needs to be small enough to not affect corrosion properties adversely by excessive formation of Cr-carbides. If carbon is added with this intention, the content should preferably be less than 0.15 wt %.

Carbon in higher contents is generally only added to powders containing stronger carbide formers than Cr (such as Mo, V, Nb). These carbide formers create carbides that increase the wear resistance of the material. For this purpose carbon can be added to the composition as a graphite powder in amount up to 3.0% by weight. An amount of carbon more than 3.0 wt % can lead to excessive carbide formation and even partial melting of the material at sintering temperatures.

Copper can optionally be admixed to the powder in order to modify dimensional change during sintering, increase compressibility of the mix and reduce tool wear. Additionally, copper can be added in order to promote liquid phase sintering. Depending on the amount of copper already present in the alloy, the amount of copper to be admixed can be varied. However the total quantity of copper in the composition should be maximum 7% by weight, as a higher amount of copper will tend to form free copper phase after sintering, which can lead to galvanic corrosion.

It may in some cases be preferred to add nickel and/or molybdenum to the powder composition instead of alloying the powder during atomization. For this purpose pure powders, such as copper or nickel powders, or powders containing these elements, such as ferroalloys, are used. As for copper, depending on the amount of nickel and/or molybdenum already present in the alloy, the amount of nickel and/or molybdenum to be admixed can be varied. However the total quantity of nickel and/or molybdenum in the composition should be max 9.0 wt % for nickel and max 7.0 wt % for molybdenum.

Boron-containing powders may optionally be added to the composition, such as NiB or FeB. Boron induces liquid sintering, promotes shrinkage and increases sintered density. However, high additions tend to lead to brittle boride-formation in the material, affecting both mechanical and corrosion properties adversely. If added, the optimal boron content of the composition is 0.05-0.50 wt %.

Other substances such as hard phase materials and machinability enhancing agents, such as MnS, $MoS_2$, $CaF_2$, etc. may be added.

Sintering

The stainless steel powder composition is transferred into a mould and subjected to cold or warm compaction at a compaction pressure of about 400-2000 MPa. The obtained green component should have a green density not less than 5.6 g/cm$^3$, preferably between 6.2-7.0 g/cm$^3$. The green component is further subjected to sintering in atmosphere containing 5-100 vol-% $N_2$ at temperature of about 1000-1400° C. To achieve better corrosion resistance the sintering temperature should be above the temperature of the $Cr_2N$ formation.

Changing the sintering temperature provides the possibility to regulate nitrogen content in the material. Increasing the temperature will tend to reduce nitrogen content in the material but increase the diffusion coefficient of the N in the austenite and promote better homogenisation of the material. On the contrary, lower sintering temperature will allow inserting higher amount of nitrogen in the steel. Taking into consideration the differences between nitrogen solubility at different temperatures additional steps at lower temperatures for nitriding and at higher temperature for homogenisation can be applied during sintering process. For example, a nitriding step can be carried out at 1200° C. during 1 hour, followed by a sintering step at 1250° C. during 20 minutes. This procedure reduces oxides and achieves a more even nitrogen distribution in the sintered component. The preferred sintering temperature is 1100-1350° C., and more preferably 1200-1280° C.

The duration of sintering and/or nitriding can be optimised depending of size, shape and chemical composition of the component, sintering temperature, and can also be used to control the amount of nitrogen and the diffusion of it in the component. Nitriding+sintering is preferably performed during 10 minutes to 3 hours, more preferably 15 minutes to 2 hours.

The nitrogen content of the finished component can also be regulated by changing the content of nitrogen in the atmosphere. Thus nitrogen in the component can e.g. be regulated by 1) controlling the content of nitrogen in the powder, 2) controlling the temperature and duration of sintering and optionally having a nitriding step prior to sintering, and 3) controlling the nitrogen content in the atmosphere during nitriding and/or sintering. Diffusion of nitrogen in the austenite and the homogenisation of the material can be controlled by changing the temperature during sintering and/or nitriding.

Optionally, the component may be subjected to rapid cooling directly after sintering. This may be necessary to suppress $Cr_2N$-formation, specifically for the alloys with low Sn-contents. Rapid cooling of alloys according to the invention should be performed at a rate of more than 5° C./s, preferably 10° C./s, and more preferably at 100° C./s at temperatures from 1100 to 700° C.

Post Sintering Treatment

Instead of rapid cooling, the sintered components with low Sn-additions can optionally be subjected to solution annealing at temperature higher than 1000° C., followed by rapid cooling in nitrogen containing atmosphere or quenching to dissolve excess $Cr_2N$. Components according to the invention can optionally be subjected to any type of mechanical treatments suitable for sintered components and additional treatments such as shot peening, surface coating etc.

Properties of the Finished Components

The present invention provides new low cost powder metallurgy stainless steels with good corrosion resistance and high level of mechanical properties. The obtained corrosion resistance of the sintered parts are at the same level as standard 316L.

For instance, about 25% higher tensile strength and about 70% higher yield strength can be achieved for a sintered steel component containing 18 wt % Cr, 7 wt % Ni, 0.5 wt % Mo and 0.4 wt % N compared to component made from powder steel material 316L.

The component comprises nitrogen to stabilise austenitic phases in the microstructure.

The presence of tin reduces the importance of using high cooling rates to achieve good corrosion resistance, since tin suppresses $Cr_2N$ formation. Preferably the total amount of chromium nitrides in the steel should be at most 2 wt %, more preferably at most 1 wt %.

Preferably the sintered stainless steel component comprises by weight-%: 10.5-30.0 Cr, 0.5-9.0 Ni, 0.01-2.0 Mn, 0.01-3.0 Sn, 0.1-3.0 Si, 0.1-1.0 N, optionally max 7.0 Mo, optionally max 7.0 Cu, optionally max 3.0 Nb, optionally max 6.0 V, balance iron and max 0.5 of unavoidable impurities, and having a microstructure comprising at least 40% austenitic phase.

Manufacturing costs for steel components of the present invention are lower than the corresponding standard austenitic and duplex grades.

Sintered steels of the invention can be applied as low cost replacements of existing austenitic and duplex powder metallurgical steels and used as high strength corrosion resistance steels.

EXAMPLES

Example 1

Two powders, powder 1 and 2, were manufactured by water atomisation technique. As reference samples two commercially available standard powders produced by Höganäs AB were used. Chemical and technological properties of the powders are stated in tables 1 and 2.

TABLE 1

Chemical composition of the investigated powders

| | Chemical composition, % | | | | | | | | | | |
|---|---|---|---|---|---|---|---|---|---|---|---|
| | Cr | Ni | Mo | Mn | Si | Cu | Sn | N | C | O | S |
| Powder 1 | 18.36 | 7.23 | 0.52 | 0.09 | 0.87 | 0.01 | — | 0.032 | 0.014 | 0.22 | 0.004 |
| Powder 2 | 17.73 | 7.65 | 0.5 | 0.11 | 0.71 | 1.01 | 1.49 | 0.043 | 0.013 | 0.2 | 0.004 |
| 316L | 17 | 12.7 | 2.2 | 0.1 | 0.8 | — | — | 0.06 | 0.02 | 0.26 | 0.004 |
| Cold 100 | 19 | 19.1 | 6.4 | 0.1 | 0.9 | — | — | 0.03 | 0.013 | 0.20 | 0.004 |

TABLE 2

Sieve analyses and properties of the powders

| | Sieve analyze, % | | | | | | | AD, | Flow, |
|---|---|---|---|---|---|---|---|---|---|
| | +212 | −212 + 180 | −180 + 150 | −150 + 106 | −106 + 75 | −75 + 45 | −45 | g/cm$^3$ | c/50 g |
| Powder 1 | 0 | 0 | 1.2 | 11.3 | 19.4 | 30.6 | 36.9 | 2.67 | 33.8 |
| Powder 2 | 0 | 0.1 | 1 | 10.9 | 18 | 29.7 | 39.7 | 2.66 | 32.59 |
| 316L | 0 | 0 | 0.5 | 5.3 | 49.2 | | 45 | 2.69 | 29 |
| Cold 100 | 0 | 0 | 0.5 | 4.72 | 51.78 | | 43 | 2.67 | 29 |

The powders 1 and 2 were mixed with 1% Amide Wax PM as a lubricant. Standard TS bars, according to SS-EN ISO 2740, were used as samples for investigations. Samples were compacted to density 6.4 g/cm$^3$. Compaction pressure is stated in table 3

TABLE 3

Compaction pressure for the investigated materials

| No | Mix composition | Green density, g/cm$^3$ | Compaction pressure, MPa |
|---|---|---|---|
| 1 | Powder 1 + 1 wt % Amide Wax PM | 6.4 | 690 |
| 2 | Powder 2 + 1 wt % Amide wax PM | 6.4 | 780 |

Two sintering trials were carried out with investigated powders according to conditions, presented in table 4. Sintering atmosphere was 50% $H_2$+50% $N_2$ during whole sintering cycle. The reference samples were sintered in pure hydrogen at temperature 1250° C., 30 min followed by conventional cooling.

TABLE 4

Sintering conditions during sintering process

| | Sintering 1 | Sintering 2 |
|---|---|---|
| Delubrication | 540° C., 10 min | 540° C., 10 min |
| Nitriding | 1200° C., 60 min | 1200° C., 60 min |
| Sintering | 1250° C., 30 min | 1250° C., 30 min |
| Cooling | Rapid cooling | Conventional cooling |
| Sintering atmosphere | 50% $H_2$ + 50% $N_2$ | 50% $H_2$ + 50% $N_2$ |

Figure 2:
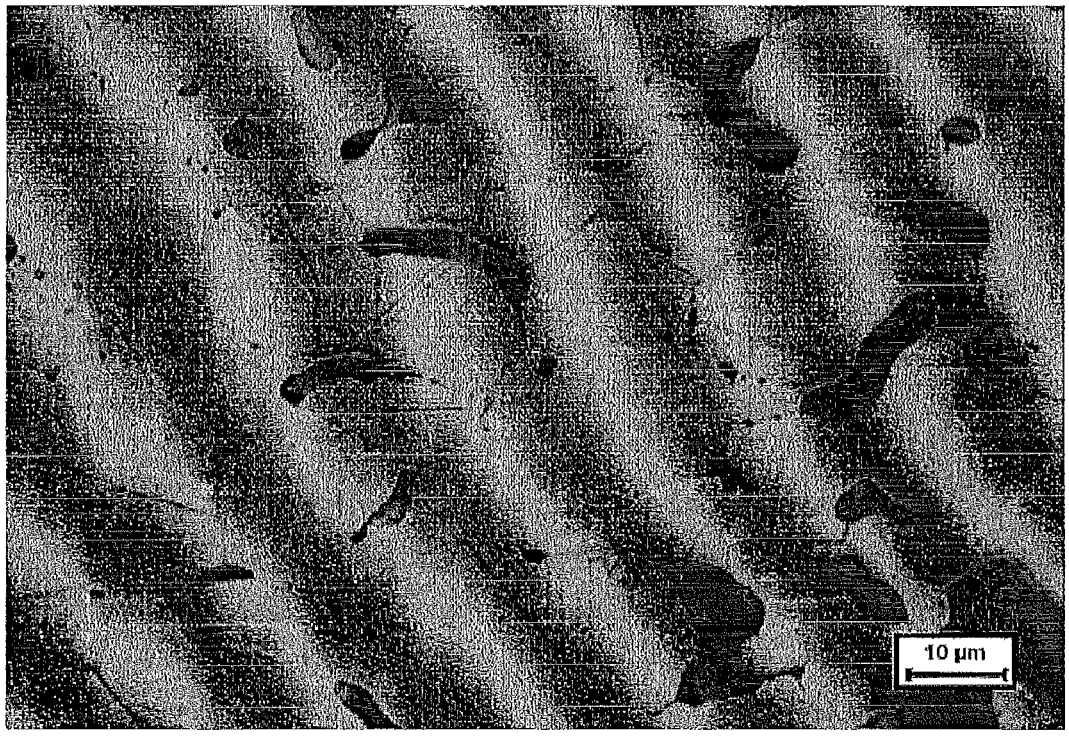
FIG. 2 shows the microstructure of a steel component made from Powder 2 after sintering in the mix 50% Hydrogen+50% Nitrogen followed by conventional cooling, etched by Glyceregia

The microstructure of the steel 2 and 4 based on Powder 1 and Powder 2 are presented in FIGS. 1, 2. As can be seen in FIG. 1, steel 2 made from Powder 1 showed high degree of sensitisation after sintering in a nitrogen containing atmosphere with conventional cooling. In FIG. 2, steel 4 based on Powder 2, and containing Tin as a stabilizer against $Cr_2N$ formation, shows a completely austenitic structure with few separate chromium-nitrides on the grain boundaries.

The mechanical properties, tested according to SS-EN ISO 10002-1, of the steels are presented in table 5. Corrosion resistance was evaluated by immersion test in 5% NaCl aqueous solution. Parts of TS bars were used as samples. Four pieces of the each material were used in the corrosion test. Time of the first corrosion appearance (rating B) was determined for each material.

TABLE 5

Properties of sintered components

| Steel no | Powder | Sint. Trial | SD, g/cm$^3$ | Nitrogen content, wt % | Rm, MPa | $R_{0.2}$, MPa | A, % | Corrosion resistance, time [h] for rating "B" |
|---|---|---|---|---|---|---|---|---|
| 1 | Powder1 | 1 | 6.75 | 0.567 | 522 | 361 | 11.8 | 8 |
| 2 | Powder1 | 2 | 6.69 | 0.841 | 548 | 376 | 3.8 | 2 |
| 3 | Powder 2 | 1 | 6.86 | 0.405 | 509 | 350 | 14.1 | 150 |
| 4 | Powder 2 | 2 | 6.85 | 0.415 | 507 | 360 | 11.7 | 150 |
| 5 | 316L | Ref. | 6.73 | 0.0235 | 320 | 176 | 18.2 | 50 |
| 6 | Cold 100 | Ref | 6.78 | 0.0335 | 343 | 211 | 11.5 | 150 |

SD—Sintered density
Rm—Ultimate tensile strength
$R_{0.2}$—Yield strength
A—Elongation.

As can be seen from the table 5, steels 1-4, made from powders 1-2 possess much higher yield and tensile strength compared to steels 5 and 6 made from the standard grades 316L respectively Cold 100.

The corrosion resistance of the steel 2 and 3, made from powder 2, are better than steel 5 made from powder grade 316L, and comparable with steel 6 made from high alloyed grade Cold 100.

However, steels 1-2 based on powder 1, showed sensitisation and poor corrosion resistance, even though the sensitisation level was much lower for the steel, sintered with rapid cooling.

Example 2

Powder 3 was manufactured by water atomisation technique. As a reference samples standard powders produced by Höganäs AB were used. Chemical and technological properties of the powders are stated in tables 6 and 7.

TABLE 6

Chemical composition of the investigated powders

| | Chemical composition, % | | | | | | | | | | |
|---|---|---|---|---|---|---|---|---|---|---|---|
| Mark | Cr | Ni | Mo | Mn | Si | Cu | Sn | N | C | O | S |
| Powder 3 | 18.0 | 5.3 | — | — | 0.65 | 1.03 | 0.41 | 0.26 | 0.058 | 0.26 | 0.003 |
| 316L | 17 | 12.7 | 2.2 | 0.1 | 0.8 | — | — | 0.06 | 0.02 | 0.26 | 0.004 |
| Cold 100 | 19 | 19.1 | 6.4 | 0.1 | 0.9 | — | — | 0.03 | 0.013 | 0.20 | 0.004 |

Particle size of the powders was less than 150 μm.

Powders were mixed with 1% Amide Wax PM as a lubricant. Standard TS bars were used as samples for investigations. Samples were compacted to density 6.4 g/cm$^3$. Compaction pressure for developed material is stated in table 7.

TABLE 7

Compaction pressure for the investigated material

| No | Mix composition | Density, g/cm$^3$ | Compaction pressure, MPa |
|---|---|---|---|
| 1 | Powder 3 + 1% Amide Wax PM | 6.4 | 750 |

Two sintering trials were carried out with investigated powders according to conditions, presented in table 8. The two trials differed in the composition of the sintering atmosphere.

TABLE 8

Sintering conditions during sintering process

| | Sintering 3 | Sintering 4 |
|---|---|---|
| Delubrication | 540° C., 10 min | 540° C., 10 min |
| Sintering/nitriding | 1250° C., 45 min | 1250° C., 45 min |
| Cooling | Conventional cooling | Conventional cooling |
| Sintering atmosphere | 25% $N_2$ + 75% $H_2$ | 10% $N_2$ + 90% $H_2$ |

Reference samples were sintered in pure hydrogen at temperature 1250° C., 30 min followed by conventional cooling.

Figure 3:
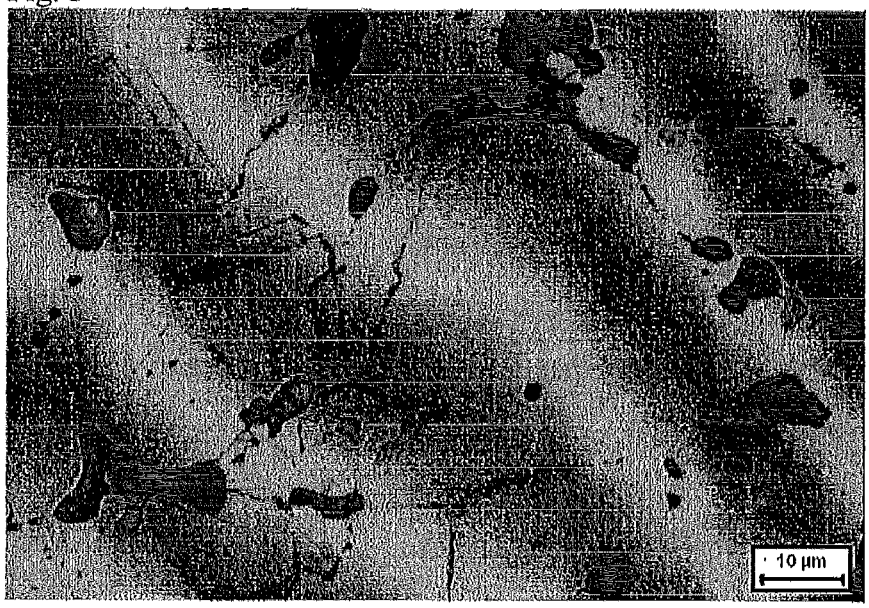
FIG. 3 shows the microstructure of a steel component made from Powder 3 after sintering in the mix 75% Hydrogen+25% Nitrogen followed by conventional cooling, etched by Glyceregia.

The microstructure of the material made from Powder 3 according to the first sintering trial, sintering 1 of table 8, is shown in FIG. 3. This sample showed completely austenitic microstructure with some nitrides on the grain boundaries, but no lamellar nitrides was observed.

Figure 4A:
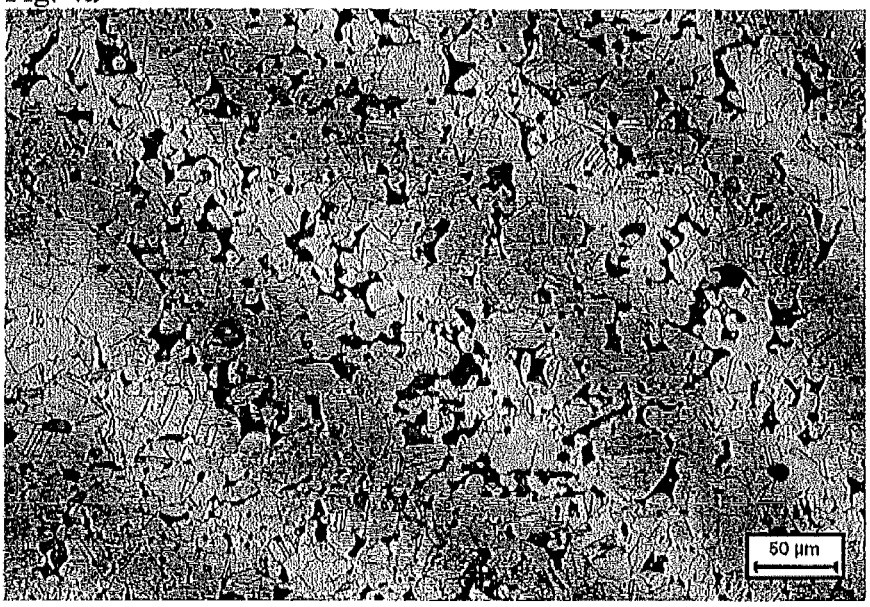
FIGS. 4*a* and 4*b* are showing the microstructure of a steel component made from Powder 3 after sintering in the mix 90% Hydrogen+10% Nitrogen followed by conventional cooling, etched by Glyceregia in different magnifications.
Figure 4B:
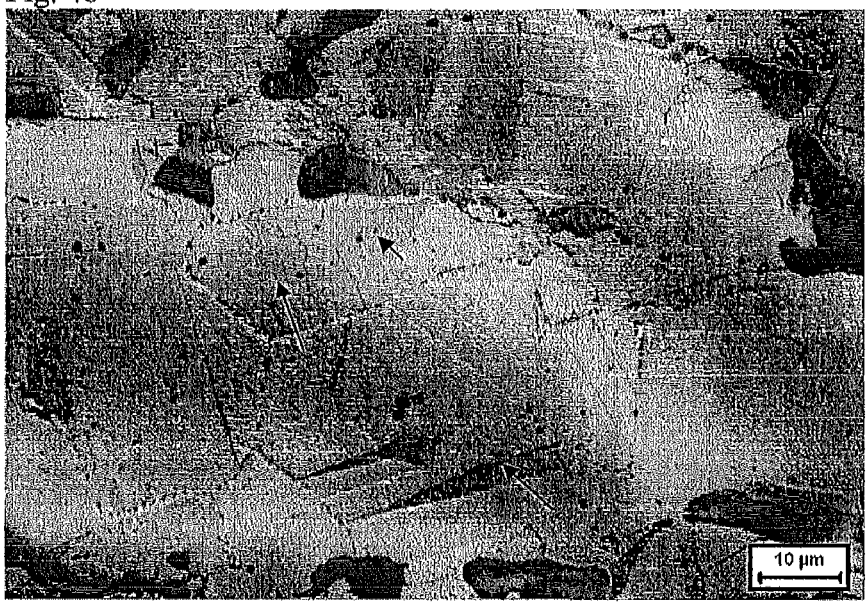

On the other hand when sintering in the atmosphere, which contains 10% of $N_2$ and 90% hydrogen ("Sintering 3" of Table 8) the material shows a dual phase austenite-ferrite microstructure. The microstructure is shown in FIGS. 4*a* and 4*b* at different magnification levels. The amount of ferrite is approximately 8 to 10%, grain boundaries are clean from the nitrides.

Mechanical properties, tested according to SS-EN ISO 10002-1, of the samples are presented in table 9.

Figure 5:
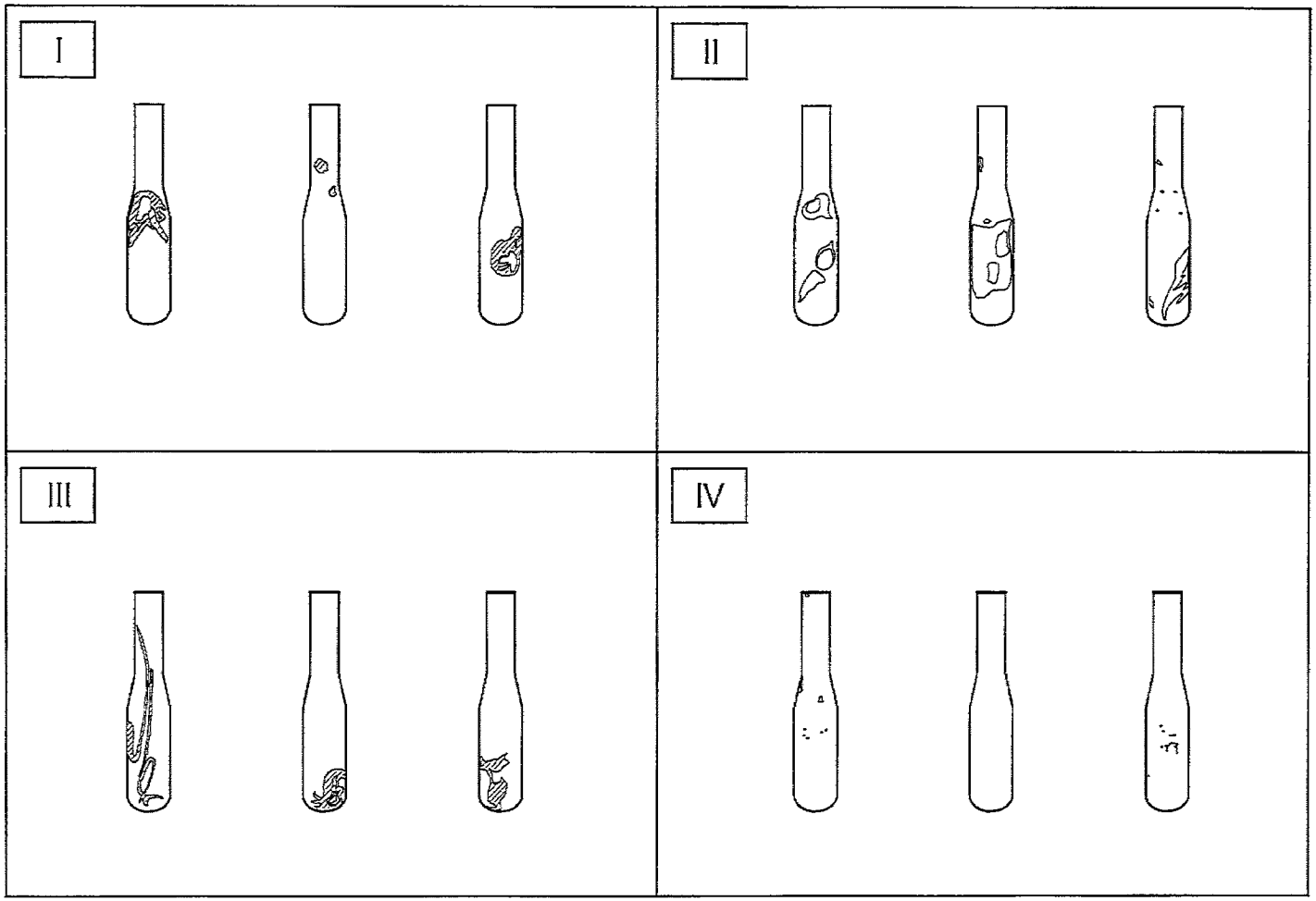
FIG. 5 shows different samples after 75 hours of immersion test in a 5% NaCl aqueous solution.

Corrosion resistance was evaluated by an immersion test in 5% NaCl aqueous solution. Parts of TS bars were used as samples. Three pieces of the each material were used in the corrosion test. Time of the first corrosion appearance (rating B) was determined for each material. The results of the immersion test are presented in FIG. 5 and table 9. The different samples are sample I which is Powder 3 sintered at conditions described as "Sintering 3" in table 8. Furthermore sample II is Powder 3 sintered at conditions described as "Sintering 4" in table 8. Two reference samples III and IV of standard grades 316 L respectively Cold 100 were sintered in pure hydrogen at temperature 1250° C., 30 min followed by conventional cooling.

TABLE 9

Sintered properties of the investigated materials

| Sample | Material | Sint. Trial | SD, g/cm$^3$ | Nitrogen content, % | Rm, MPa | $R_{0.2}$, MPa | A, % | Corrosion resistance, time [h] for rating "B" |
|---|---|---|---|---|---|---|---|---|
| I | Powder 3 | 1 | 6.87 | 0.4 | 534 | 360 | 12.9 | 44 |
| II | Powder 3 | 2 | 6.83 | 0.3 | 520 | 317 | 17.9 | 70 |
| III | 316L | Ref. | 6.73 | 0.0235 | 320 | 176 | 18.2 | 40 |
| IV | Cold 100 | Ref | 6.78 | 0.0335 | 343 | 211 | 11.5 | >150 |

SD—Sintered density

Rm—Ultimate tensile strength $R_{0.2}$—Yield strength

A—Elongation.

As can be seen from the table 9, the developed steel (Powder 3) possess much higher strength comparing with standard grades 316L and Cold 100. From FIG. 5 and table 9 it can be seen that the corrosion resistance of the developed material (sample I and II) is similar or higher than the corrosion resistance of 316L hydrogen sintered stainless steel (sample III), depending on sintering atmosphere. Sample II sintered in an atmosphere containing 10% of $N_2$ showed better corrosion resistance than Sample I sintered in an atmosphere containing 25% $N_2$, both samples made from Powder 3. Sample II showed better corrosion resistance because much less nitrides were indicated in the microstructure after sintering.

The invention claimed is:

1. A water atomized stainless steel powder which comprises by weight-%:
10.5-30.0 Cr
0.5-8.0 Ni
0.01-2.0 Mn
0.01-3.0 Sn
0.1-3.0 Si
0.01-0.4 N
0.01-1.5 Mo
optionally max 7.0 Cu
optionally max 3.0 Nb
optionally max 6.0 V
balance iron and max 0.5 of unavoidable impurities.

2. The water atomized stainless steel powder according to claim 1, wherein the Mn content is between 0.01-0.50%, by weight.

3. The water atomized stainless steel powder according to claim 1, wherein the Sn content is 0.10-2.0%, by weight.

4. The water atomized stainless steel powder according to claim 1, wherein the N content is 0.01-0.10%, by weight.

5. The water atomized stainless steel powder according to claim 1, wherein the Si content is 0.3-0.9%, by weight.

6. The water atomized stainless steel powder according to claim 1, wherein the Ni content is 1.0-8.0%, by weight.

7. The water atomized stainless steel powder according to claim 1, wherein the powder has, by weight-%:
max 7.0 Cu
max 3.0 Nb
max 6.0 V.

8. The water atomized stainless steel powder according to claim 1, wherein the N content is 0.26-0.40%, by weight.

9. A water atomized stainless steel powder which comprises by weight-%:
10.5-30.0 Cr
0.5-8.0 Ni
0.01-2.0 Mn
0.01-3.0 Sn
0.1-3.0 Si
0.01-0.4 N
0.01-7.0 Mo
optionally max 7.0 Cu
optionally max 3.0 Nb
optionally max 6.0 V
balance iron and max 0.5 of unavoidable impurities.

10. A powder composition comprising the water atomized stainless steel powder according to claim 1, further comprising by weight-%:
0.05-2.0 lubricants
optionally max 3% C
optionally max 7.0 Cu
optionally max 3.0 Nb
optionally max 6.0 V
optionally max 0.5 B
optionally hard phase materials and machinability enhancing agents
and max 0.5 of unavoidable impurities.

11. A method for producing sintered components comprising the steps of:
a) preparing a stainless steel powder composition according to claim 10,
b) subjecting the composition to compaction between 400 and 2000 MPa,
c) sintering the obtained green component in a nitrogen containing atmosphere, at temperatures between 1000-1400° C.,
d) optionally subjecting the sintered component to rapid cooling,
e) optionally, solution annealing the sintered component at temperatures higher than 1000° C. followed by rapid cooling or quenching.

12. A method for producing sintered components according to claim 11, wherein the component is subjected to a nitriding step prior to the sintering step c), which nitriding step is performed at a temperature that is 20-300° C. lower than the sintering temperature, the atmosphere during the nitriding step having a nitrogen content of 5-100% $N_2$.

13. A sintered stainless steel component, comprising by weight-%:
10.5-30.0 Cr
0.5-8.0 Ni
0.01-2.0 Mn
0.01-3.0 Sn
0.1-3.0 Si
0.1-1.0 N
optionally max 3.0 C
0.01-1.5 Mo
optionally max 7.0 Cu
optionally max 3.0 Nb
optionally max 6.0 V
balance iron and max 0.5 of unavoidable impurities,
and having a microstructure comprising at least 40% austenitic phase.

14. The sintered stainless steel component according to claim 13 produced by the method comprising the steps of:
a) preparing a stainless steel powder composition;
b) subjecting the composition to compaction between 400 and 2000 MPa;
c) sintering the obtained green component in a nitrogen containing atmosphere, at temperatures between 1000-1400° C.;
d) optionally subjecting the sintered component to rapid cooling;
e) optionally, solution annealing the sintered component at temperatures higher than 1000° C. followed by rapid cooling or quenching.

15. The powder composition according to claim 10, wherein the composition has, by weight-%:
max 3% C
max 7.0 Cu
max 3.0 Nb
max 6.0 V
max 0.5 B.

16. The powder composition according to claim 10, wherein the hard phase materials and machinability enhancing agents are MnS, $MoS_2$, or $CaF_2$.

17. The sintered stainless steel component according to claim 13, wherein the component has, by weight-%:
max 3.0 C
max 7.0 Cu
max 3.0 Nb
max 6.0 V.

* * * * *